US009155444B2

(12) United States Patent
Lee

(10) Patent No.: US 9,155,444 B2
(45) Date of Patent: Oct. 13, 2015

(54) DISHWASHER

(75) Inventor: Jae Woo Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 156 days.

(21) Appl. No.: 13/564,327

(22) Filed: Aug. 1, 2012

(65) Prior Publication Data

US 2013/0038186 A1 Feb. 14, 2013

(30) Foreign Application Priority Data

Aug. 12, 2011 (KR) ..... 10-2011-0080878

(51) Int. Cl.
*A47L 15/42* (2006.01)

(52) U.S. Cl.
CPC ..... *A47L 15/4261* (2013.01); *A47L 15/4265* (2013.01)

(58) Field of Classification Search
CPC ..... F24C 15/023; E05Y 2900/20; E05Y 2900/304; E05Y 2900/308; A47L 16/4261; A47L 15/4265
USPC ..... 312/228, 311, 319.1, 319.2, 319.4; 134/57 D, 57 DL, 56 D; 126/191, 194
See application file for complete search history.

(56) References Cited

U.S. PATENT DOCUMENTS

| | | | | |
|---|---|---|---|---|
| 2,921,575 | A * | 1/1960 | Fry | 126/191 |
| 3,049,114 | A * | 8/1962 | Carnahan et al. | 126/191 |
| 3,058,737 | A * | 10/1962 | Schibley | 267/177 |
| 4,475,530 | A * | 10/1984 | Albertson | 126/110 B |
| 5,226,706 | A * | 7/1993 | Tuller | 312/228 |
| 5,980,006 | A | 11/1999 | Wilhelmstätter et al. | |
| 2008/0272678 | A1 * | 11/2008 | Tynes et al. | 312/319.4 |
| 2009/0072686 | A1 * | 3/2009 | Vooren et al. | 312/319.4 |
| 2011/0215691 | A1 * | 9/2011 | Keskin et al. | 312/319.2 |

FOREIGN PATENT DOCUMENTS

| | | | |
|---|---|---|---|
| DE | 8329611.5 | | 7/1984 |
| DE | 9312545.3 | | 11/1993 |
| DE | 9301160.1 | | 7/1994 |
| DE | 4427122 | A1 | 2/1996 |
| DE | 102007058690 | A1 | 6/2009 |
| EP | 2147627 | A1 | 1/2010 |
| KR | 97-20818 | | 6/1997 |
| KR | 2000-0019841 | | 11/2000 |
| WO | 2006/137039 | A2 | 12/2006 |

OTHER PUBLICATIONS

Extended European Search Report issued Dec. 5, 2012, in corresponding European Patent Application No. 12178679.2.

* cited by examiner

*Primary Examiner* — James O Hansen
(74) *Attorney, Agent, or Firm* — Staas & Halsey LLP

(57) ABSTRACT

A dishwasher that enables a user to adjust a load of a spring depending on material and weight of a cover that is attached to a door of the dishwasher. The dishwasher includes a housing having a bottom, a rear, and side covers, a door rotatably installed on a front surface of the housing, a door hinge installed onto each lower end of the door while being rotatably coupled to the housing, a spring configured to adjust a rotation of the door, and an apparatus of adjusting the spring configured to adjust a load of the spring. The apparatus includes a movable bracket connected to the spring, an adjustment member which enables the movable bracket to move up and down, and a support bracket configured to support the adjustment member. A position verification hole is perforated through the housing such that the apparatus is checked from outside the housing.

17 Claims, 10 Drawing Sheets

DISHWASHER

CROSS-REFERENCE TO RELATED APPLICATIONS

This application claims the benefit of Korean Patent Application No. 10-2011-0080878, filed on Aug. 12, 2011 in the Korean Intellectual Property Office, the disclosure of which is incorporated herein by reference.

BACKGROUND

1. Field

Embodiments of the present disclosure relate to an apparatus for controlling a spring according to a weight of a door of a dishwasher.

2. Description of the Related Art

In general, a dishwasher is an apparatus made to clean tableware easily and sanitarily, and includes a wash water pump to spray wash water through spray nozzles. The wash water sprayed through spray nozzles is ejected with high pressure, and splashes on a surface of tableware placed on a tableware rack. Therefore, by the pressure of wash water splashed on the surface of tableware, dirt remained on the surface of tableware is removed.

A door of a dishwasher is rotatably installed onto a main body of the dishwasher using a hinge member. The bottom of the door is assembled to the hinge member, while one end of a spring fixed onto the main body of the dishwasher is connected to the hinge member to pull the door of the dishwasher.

Therefore, as a user pulls a door using a doorknob, the door is open by a pulling force. While the door is open completely, the weight of the door surpasses a force of restoration by a spring; and therefore, the door remains open.

Lately, however, so called a "built-in" type of a dishwasher is being used, as the build-in-type dishwasher is installed into furniture in order to increase space efficiency while offering a sense of monolithic beauty at the same time.

In addition, at the time of when a built-in-type dishwasher is installed, a cover having the same design and color to furniture is coupled to a front door of the built-in-type dishwasher in order to give a sense of monolithic beauty.

If a cover is coupled to a door, depending on material and weight of the cover, a weight of the door coupled with the cover changes, and therefore, a tension of a spring which controls a rotation of the door needs to be adjusted.

In order to adjust a tension of a spring of a door, a case of the door needs to be inconveniently taken off or disassembled by a user or a service technician and adjusts the tension of the spring of the door, according to a weight of the door, by hooking the spring to a hole which is appropriately positioned for the weight of the door.

SUMMARY

Therefore, it is an aspect of the present disclosure to provide a dishwasher of which a user or a service technician can conveniently adjust a spring, according to various types of materials or a weight of a cover coupled to a door.

It is another aspect of the present disclosure to provide a dishwasher, which includes a spring with minimized left and right deviations by being able to recognize an accurate position of the spring according to a weight of a door.

It is still another aspect of the present disclosure to provide a dishwasher of which a door can be open and closed easily.

It is still another aspect of the present disclosure to provide a dishwasher with increased convenience in usage and installation by being able to recognize an appropriate installation position of a spring without disassembling a side cover.

Additional aspects of the disclosure will be set forth in part in the description which follows and, in part, will be apparent from the description, or may be learned by practice of the disclosure.

In accordance with one aspect of the preset disclosure, a dishwasher includes a housing, a door, a door hinge, a spring and an apparatus of adjusting the spring. The housing has a bottom, a rear, and side covers. The door is rotatably installed on a front surface of the housing. The door hinge is installed onto each lower end of the door while being rotatably coupled to the housing. The spring is configured to adjust a rotation of the door. The apparatus of adjusting the spring is configured to adjust a load of the spring. The apparatus includes a movable bracket, an adjustment member and a support bracket. The movable bracket is connected to the spring. The adjustment member enables the movable bracket to move up and down. The support bracket is configured to support the adjustment member. A position verification hole is perforated through the housing such that the apparatus is checked from outside the housing.

The position verification hole may be formed on the side cover.

The position verification hole may be formed in a vertical direction.

The position verification hole may be formed as at least one position verification hole.

The support bracket may include a first support bracket, a second support bracket and a connection support bracket. The first support bracket supports an upper portion of the adjustment member. The second support bracket supports a lower portion of the adjustment member while being spaced apart from the first support bracket. The connection bracket is configured to connect the first support bracket to the second support bracket. A penetration hole is formed in each of the first support bracket and the second support bracket such that the adjustment member passes through the penetration hole.

The adjustment member may include a head unit and a rotation support unit. The head unit has a slotted recess or a crossed recess, and a rotation support unit extends from the head unit downward in a shape of a cylinder while having a outer surface with a screw thread.

The movable bracket may have a cylindrical unit which penetrates a core of the movable bracket such that the movable bracket is coupled to the adjustment member. The cylindrical unit is provided at an inner surface thereof with a screw thread corresponding to the screw thread of the adjustment member.

The movable bracket may be formed through one end portion with an installation hole to which one end portion of the spring is connected.

The door hinge includes a frame, a hinge member, a roller and a wire. The frame is provided on the housing. The hinge member is coupled to a lower portion of the door. The roller is installed on the frame. The wire has one end connected to the hinge member and an opposite end connected to the spring.

The roller may include at least one of a fixed roller or a rotatable roller.

The roller may include at least one roller.

The wire may include a first connection unit having a first connection hole to connect the spring, and a second connection unit having a second connection hole to connect to the hinge member. The second connection unit may include a friction unit which makes contact with the frame to cause friction.

The friction unit may include at least one protrusion that protrudes to make a contact with the frame.

The first and the second connection units may be integrally formed with the wire through insert injection molding.

In accordance with another aspect of the present disclosure, a dishwasher includes a door, a door hinge, an elastic member and a wire. The door is rotatably installed onto a front surface of a housing. The door hinge includes a hinge bracket, which is provided on the housing, and a hinge member, which is provided on the door. The elastic member is connected to the door hinge to adjust a movement of the door. The wire connects the door hinge to the elastic member. A friction unit is formed on a predetermined portion of the wire, where the wire is connected to the door hinge, to generate friction while making contact with a frame provided on the housing.

The elastic member may include a spring.

The friction unit may include at least one protrusion which protrudes toward the frame.

The dishwasher further includes an apparatus for adjusting the elastic member. The apparatus includes a support bracket fixed to the housing, an adjustment member rotatably supported by the support bracket, and a movable bracket. One end of the movable bracket is connected to the elastic member as the movable bracket moves up and down through rotation of the adjustment member.

The apparatus may include at least one position verification hole which is formed vertically such that a position of the movable bracket is checked from outside the housing.

The housing may have an adjustment hole enabling a tool, which is used to rotate the adjustment member, to be inserted therethrough.

The door hinge may include a roller which is installed on the frame to guide the wire.

The roller may include at least one of a fixed roller or a rotatable roller.

The wire may include a first connection unit having a first connection hole configured to connect to the elastic member, and a second connection unit having a second connection hole configured to connect to the hinge member. The first and the second connection units may be integrally formed with the wire through insert injection molding.

As described above, a consumer or a technician can easily adjust a spring according to materials and weight of a cover attached to a door of the dishwasher.

In addition, since the position of a spring is recognized, even a non-experienced consumer or a non-experienced technician can easily install the door, thereby improving the convenience of use.

In addition, an apparatus of adjusting a spring is easily implemented into a simple structure at a lower material cost.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
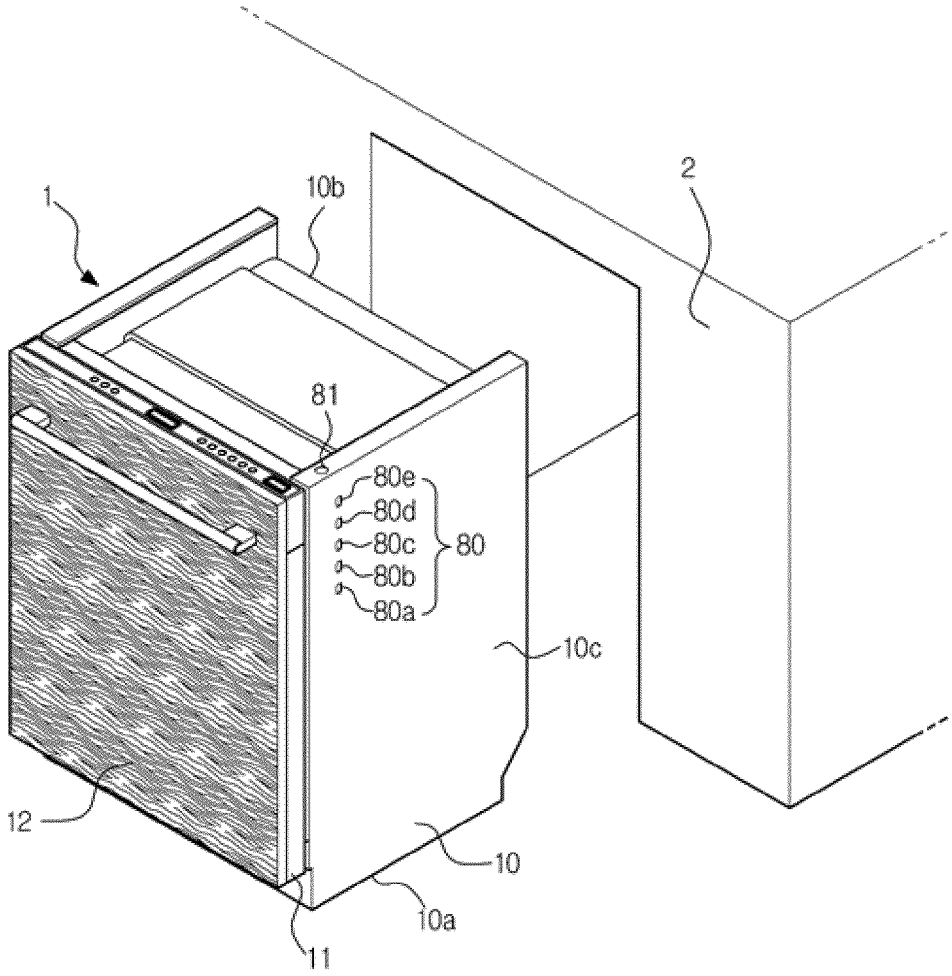
FIG. 1 is a cross-sectional view schematically illustrating a dishwasher according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view, according to an example of the present disclosure, schematically illustrating a dishwasher.

Figure 2:
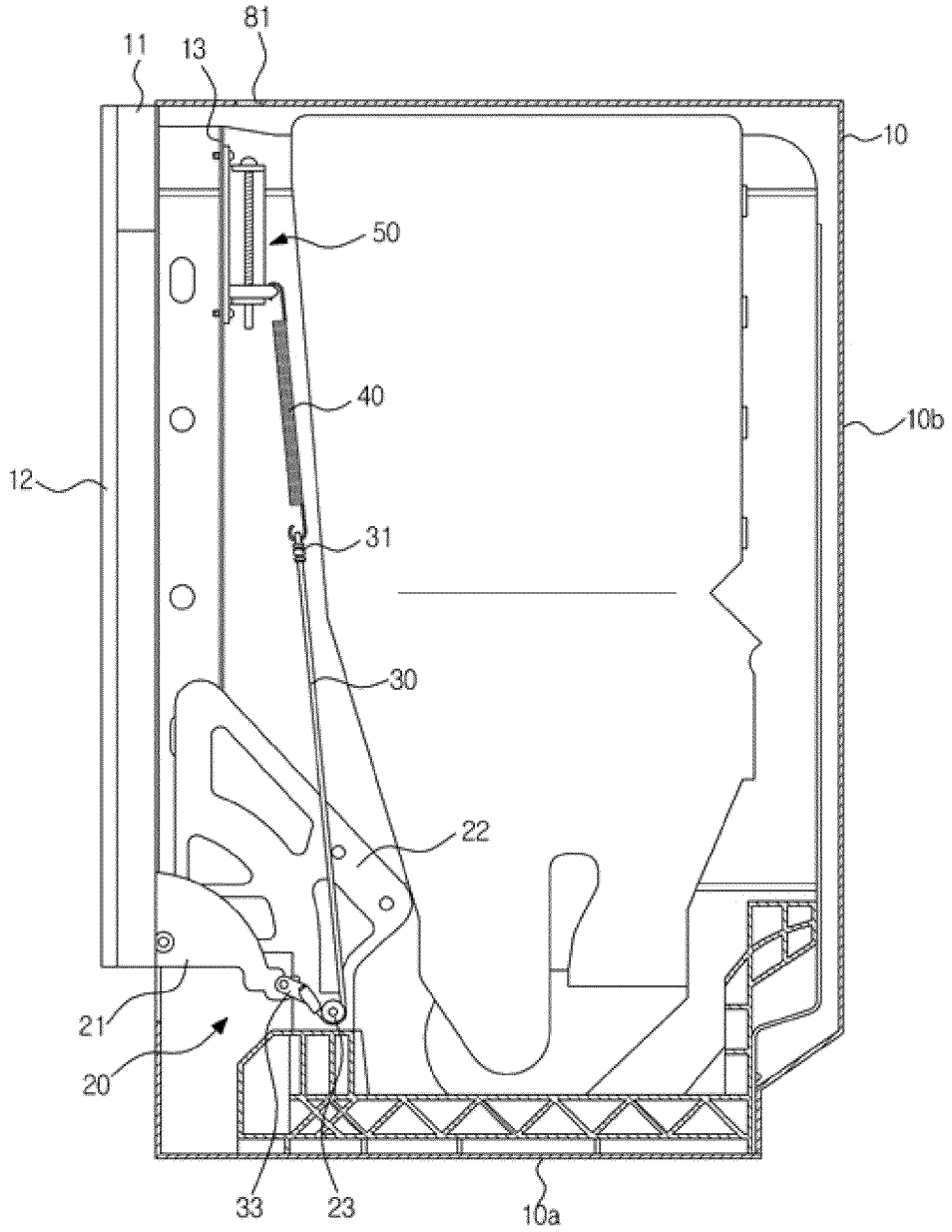
FIG. 2 is a view illustrating a door hinge and a spring adjustment apparatus of a dishwasher according to an embodiment of the present disclosure.

Referring to FIGS. 1 and 2, a dishwasher 1, which is installed inside furniture 2 while offering a sense of monolithic beauty in a kitchen space, includes a housing 10, a door 11 and a cover 12. The housing 10 includes a bottom 10*a*, a side cover 10*c* and a rear surface 10*b*. The door 11 selectively opens a front portion of the housing 10. The cover 12 is coupled to a front side of the door 11, bringing a sense of monolithic effect with the furniture 2.

As the cover 12 is coupled to the door 11 as illustrated, the weight of the door 11 changes according to material and weight of the cover 12; and therefore, a load of the spring 40 that controls a rotation of the door 11 needs to be adjusted.

Referring to FIG. 2 illustrating a status of the side cover 10*c* of the housing 10 disassembled to examine the dishwasher 1. A dishwashing tub (not shown) is provided inside the housing 10. A door hinge 20, which serves as a rotational axis of the door 11, is positioned at a lower portion of the door 11 that opens and closes a front surface of the dishwashing tub and the housing 10. A spring 40 is connected to the door hinge 20 to adjust the position of the door 11 when the door 11 rotates. A wire 30 connects between the spring 40 and the door hinge 20.

The door hinge 20 includes a frame 22 provided on the housing 10, a hinge member 21 provided at each bottom portion of the door 11, and a roller 23 installed on one end portion of the frame 22.

The roller 23 is provided to rotate, and guides a motion of the wire 30 and the spring 40.

The roller 23 includes at least one roller.

A spring adjustment apparatus 50 is installed onto an upper portion of the housing 10 to adjust a tension of the spring 40.

The spring adjustment apparatus 50 is installed onto a bracket 13 which is installed vertically at a front side inside of housing 10.

Figure 3:
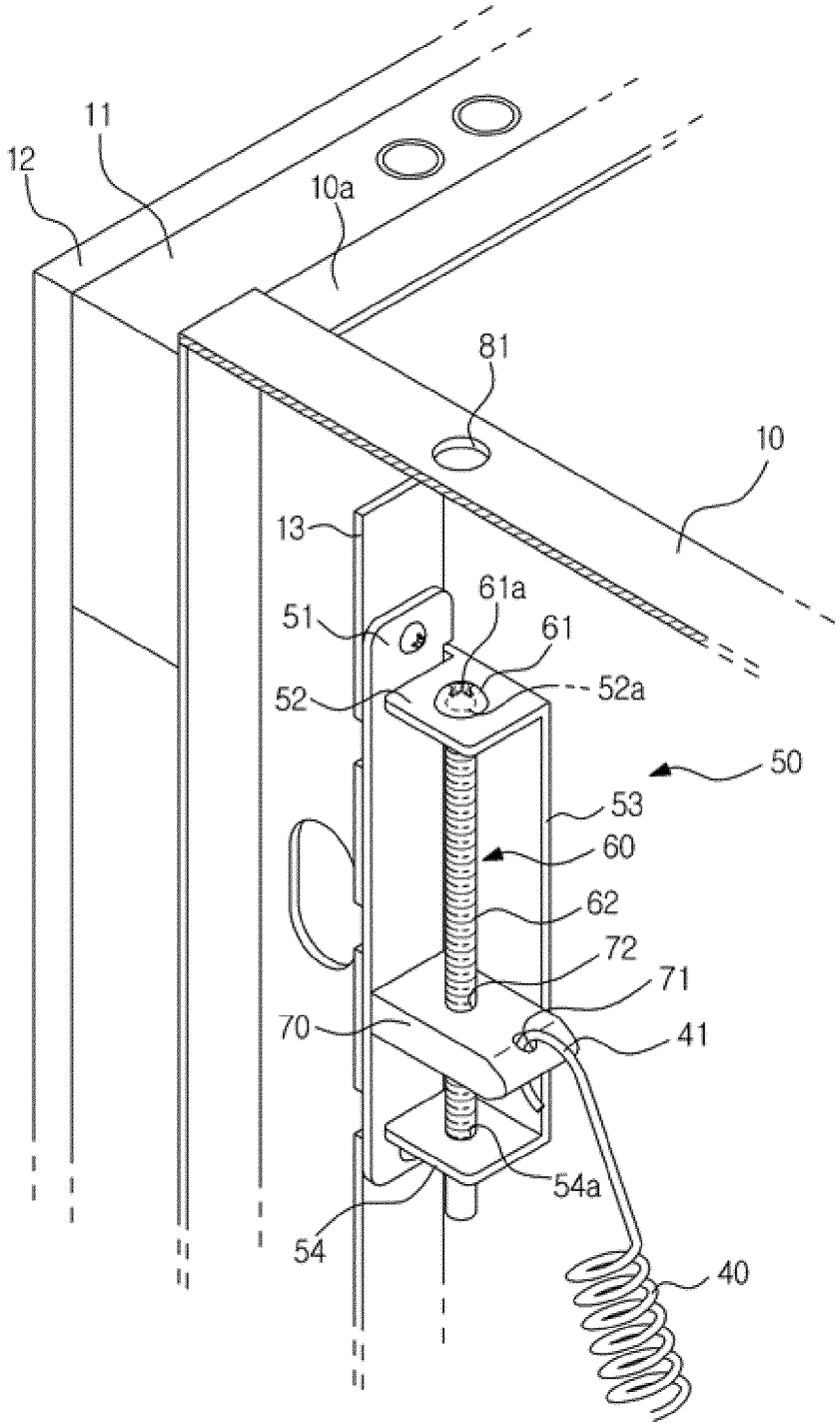
FIG. 3 and FIG. 4 are perspective views schematically illustrating a spring adjustment apparatus according to an embodiment of the present disclosure.

Referring to FIG. 3, the spring adjustment apparatus 50 includes a support bracket 51 which is fixed to the bracket 13 of the housing 10, an adjustment member 60 which is rotatable, and a movable bracket 70 which is movably provided along the adjustment member 60.

The support bracket 51 is configured to support both upper and lower end portions of the adjustment member 60. The support bracket 51 includes a first support bracket 52 which supports an upper end portion of the adjustment member 60, a second support bracket 54 which supports a lower end portion adjustment member 60, and a connection support bracket 53 which connects the first support bracket 52 to the second support bracket 54.

The connection support bracket 53 is bent to extend from the support bracket 51 which is fixed onto the bracket 13 of the housing 10. The first support bracket 52 and the second support bracket 54 are formed on an upper portion and a lower portion of the connection support bracket 53, respectively.

At a center of each of the first and the second support brackets 52, 54, a penetration hole 52*a* and a penetration hole 54*a* are formed, respectively, so that the adjustment member 60 is installed while passing through the penetration holes 52*a* and 54*a*.

The adjustment member 60 includes a head unit 61 formed with a slot 61*a*, and a rotation support unit 62 extending downward from the head unit 61 in a cylindrical shape The slot 61*a* of the adjustment member 60 may be a slotted recess or a crossed recess, although other configurations for the slot 61*a* may be used such as a square recess, slotted hex, etc. Further, the adjustment member 60 may not include a slot but instead be configured to have a hexagonal head unit 61.

The rotation support unit 62 is formed in a predetermined length, and a screw thread 63 is formed on an outer surface of the rotation support unit 62.

The adjustment member 60 is installed passing through the penetration holes 52*a* and 54*a* of the first support bracket 52 and the second support bracket 54. The adjustment member is rotatably installed to the head unit 61 of the adjustment member 60 hanging from an upper portion of the first support bracket 52.

Although the adjustment member 60 according to the example of the present disclosure is rotatably supported by the support bracket 51, the present disclosure is not limited thereto. For example, the adjustment member 60 may be rotatably supported by the frame 13 of the housing 10. For example, the support bracket 51 is integrally formed with the frame 13, and the adjustment member 60 may be supported by the support bracket 51 integrally formed with the frame 13.

The movable bracket 70 is provided to move vertically on the rotation support unit 62 of the adjustment member 60. The movable bracket 70 is provided at a core thereof with a cylindrical unit 72 to which the rotation support unit 62 is coupled.

The cylindrical unit 72 is provided at an inner surface with a screw thread 73 corresponding to the screw thread 63 of the adjustment member 60.

The movable bracket 70 is provided at one end portion with an installation unit 71 to which the spring 40 is fixed.

The spring 40 is provided at each end with a spring hook unit 41 having a shape of a hook such that the spring 40 is connected between the movable bracket 70 and the wire 30 that will be described later.

As the spring hook unit 41 is hooked onto the installation unit 71 of the movable bracket 70, the spring 40 is connected to the movable bracket 70. Accordingly, when the movable bracket 70 moves vertically, the spring 40 connected to the movable bracket 70 also moves vertically and the load of the spring 40 is adjusted.

The housing 10 is formed with a position verification hole 80 and an adjustment hole 81. The position verification hole 80 is configured to check y a position of a vertical movement of the movable bracket 70. The adjustment hole 81 is configured to allow a tool 90, which is used to rotate the adjustment member 60, to be inserted therethrough.

Figure 4:
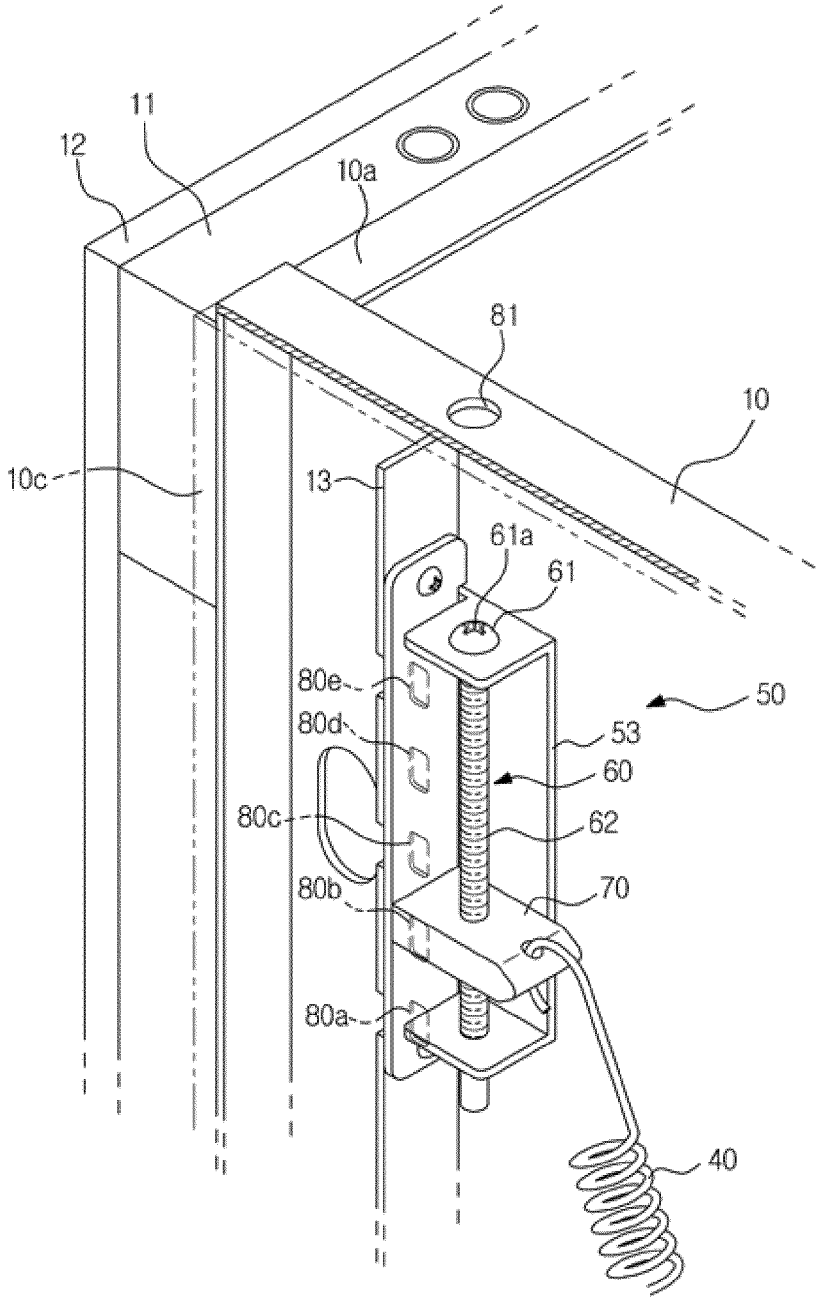

Referring to FIG. 4, the position verification hole 80 is formed at an installation position of the spring adjustment apparatus 50 located at an upper portion of the side cover 10*c* of the housing 10.

The position verification hole 80 is desired to include at least one position verification holes. The position verification hole 80 according the embodiment of the present disclosure includes five position verification holes that are vertically formed while being spaced apart from each other, but the configuration of the position verification hole 80 is not limited hereto.

Therefore, the vertical position of the movable bracket 70 is verified from an outside of the housing 10 through the position verification hole 80.

At this time, the position verification hole 80 may include a hole or a slot formed in a vertical direction, so that the movable range of the movable bracket 70 is verified.

In addition, the adjustment hole 81 is formed at the bottom 10*a* of the housing 10 such that a tool, which is used to rotate the adjustment member 60, is inserted therethrough.

A position and a shape of the adjustment hole 81 may vary depending on the type of a tool, but is desired to position corresponding to the head unit 61 of the adjustment member 60.

Figure 5:
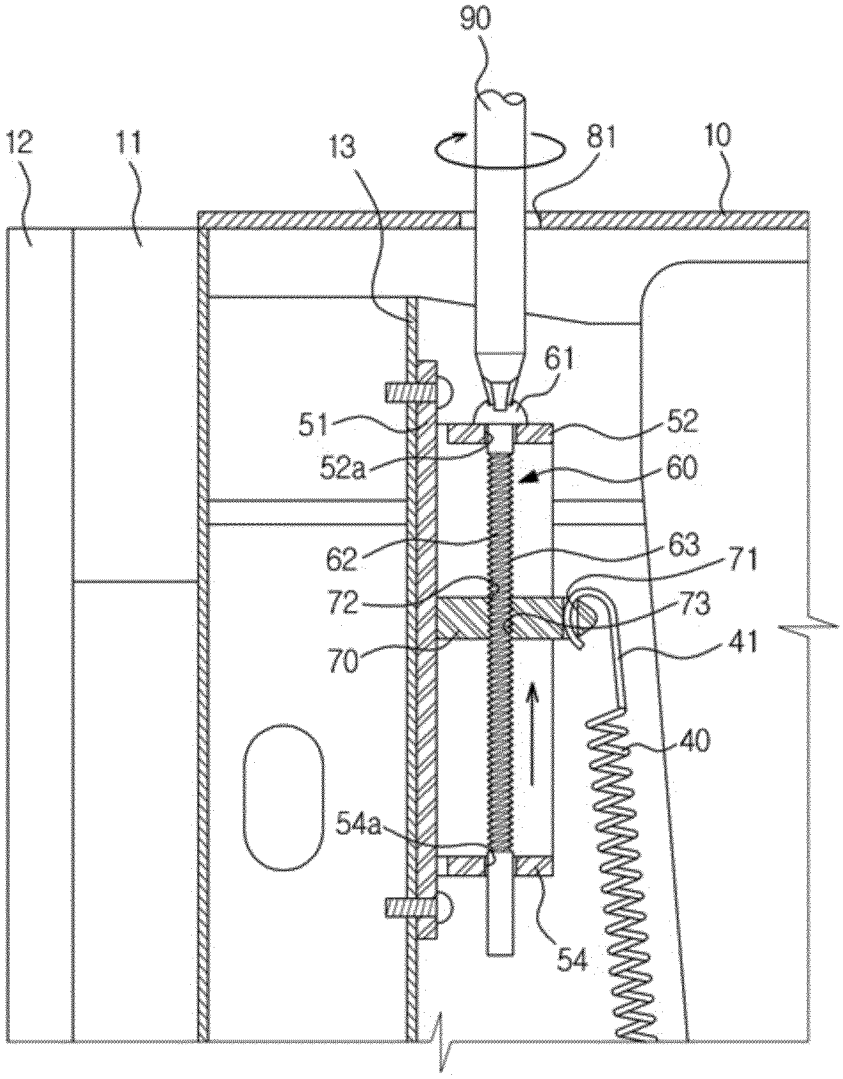
FIG. 5 and FIG. 6 are views schematically illustrating a motion of a spring adjustment apparatus according to an embodiment of the present disclosure.

A motion of the spring adjustment apparatus 50 of the dishwasher 1 having the above described configuration is illustrated with reference to FIGS. 4 and 5.

As the cover 12 is installed to the front surface of the door 11 of the dishwasher 1, the weight of the door 11 is changed, and therefore, a load of the spring 40 which controls a rotation of the door 11 needs to be adjusted.

When viewed the motion of the spring adjustment apparatus 50, an adjustment member 60, which is supported by the support bracket 51 while passing through the penetration holes 52*a* and 54*a* of the first support bracket 52 and the second support bracket 54, is rotated in a clockwise (CW) direction by inserting the tool 90 through the adjustment hole 81 formed at the housing 10.

The movable bracket 70 moves to an upper direction by the screw thread 73, which is coupled with the screw thread 63 of the rotation support unit 62 of the adjustment member 60, along with a rotation of the adjustment member 60.

As the movable bracket 70 moves, the spring 40 connected to the movable bracket 70 is pulled, and therefore, may control more load.

On the other hand, when the adjustment member 60 is rotated in a counter-clockwise direction (CCW), the movable bracket 70 is moved to a lower direction of an adjustment member 60.

Accordingly, the force applied to the spring 40 connected to the movable bracket 70 decreases, and therefore, the spring 40 may control a low load.

The five position verification holes 80 perforated through the housing 10 to verify a vertical motion of the movable bracket 70 are formed vertically on each lateral side of the housing 10 while being spaced apart from each other.

Therefore, a user or a service technician may adjust a load of the spring 40 easily and accurately by inserting the tool 90 through the adjustment hole 81 of the housing 10 and then rotating an adjustment member 60 while visibly verifying the position of the movable bracket 70 positioned at the position verification hole 80.

By adjusting the spring 40 through the position verification hole 80, the spring 40 on both sides of the housing 10, that is, on the left and the right of a housing 10, may be adjusted equally.

Adjustment positions of the spring 40 according to the weight change of the door 11 with the cover 12 attached are shown in Table 1.

TABLE 1

| Position Verification Holes | Weight (Kg) |
|---|---|
| Level 1 | 0-3 |
| Level 2 | 3-4.3 |
| Level 3 | 4.3-6 |
| Level 4 | 6-7 |
| Level 5 | 6.5-8 |

As shown on [Table 1], the lowest position verification hole 80*a* controls the lightest weight, and on the other hand, the highest position verification hole 80*e* controls the heaviest weight.

Figure 6:
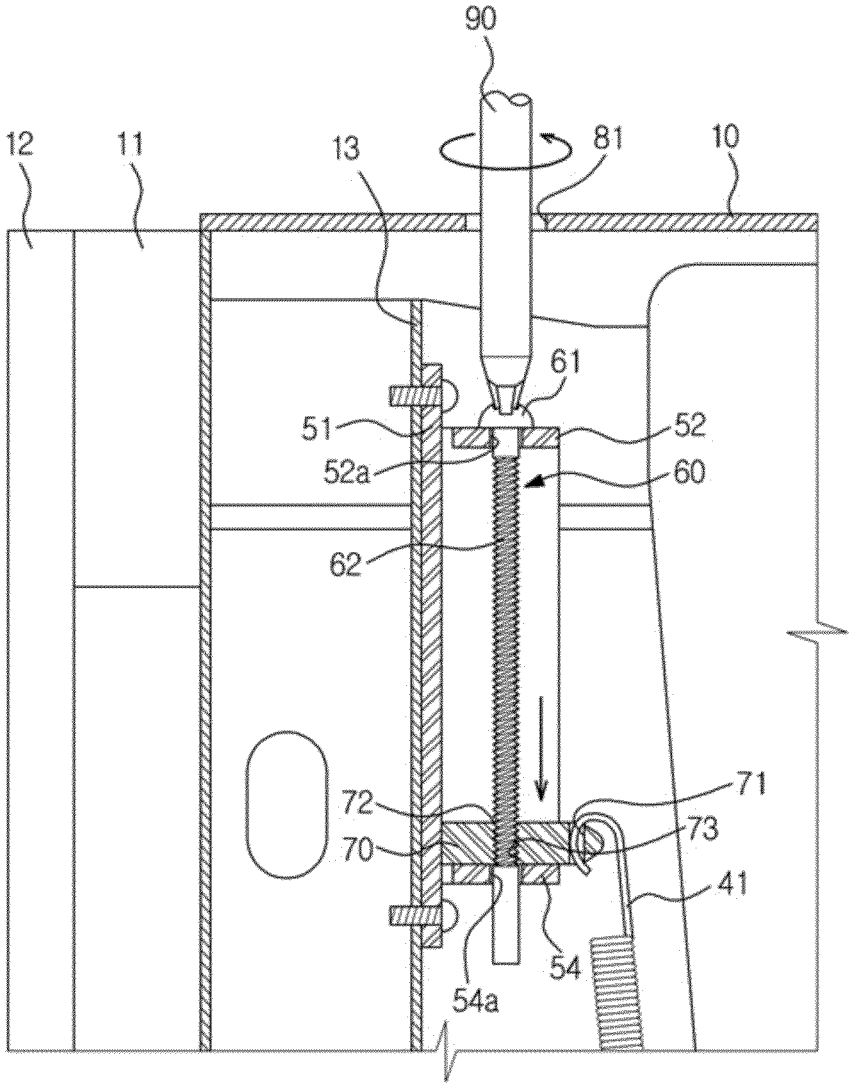
Figure 7:
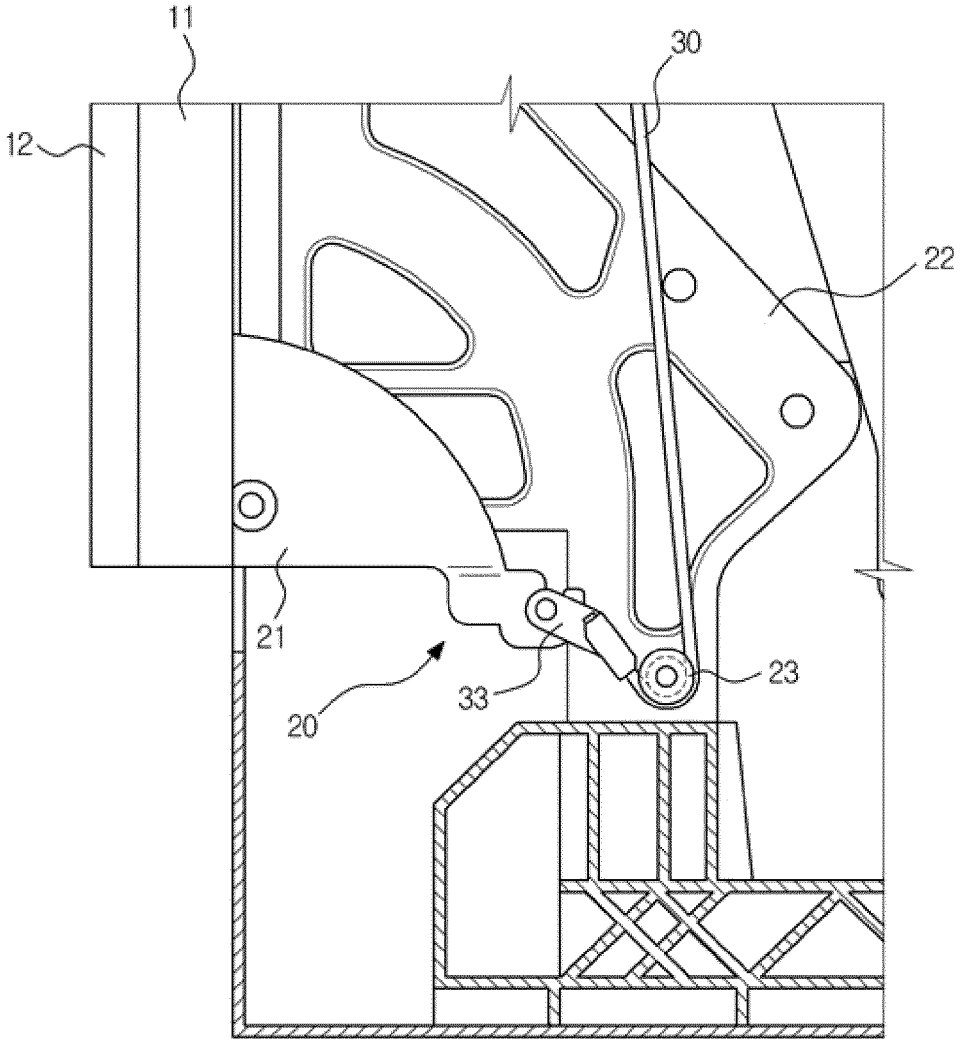
FIG. 7 is a view schematically illustrating a door hinge according to an embodiment of the present disclosure.

Referring to FIGS. 6 and 7, the door hinge 20 includes the frame 22 provided on each side of the housing 10, the hinge member 21 provided at each bottom portion of the door 11, and the roller 23 installed on one end portion of the frame 22.

The wire 30 is guided by the roller 23, and controls the door 11 in relation to the spring 40 when the door hinge 20 rotates.

A slot 23*a* is formed at an outer surface of the roller 23, and guides a motion of the wire 30.

The wire 30 connecting the hinge member 21 to the spring 40 includes a first connection unit 31, which connects to the spring 40, and a second connection unit 33, which connects to the hinge member 21.

The first connection unit 31 of the wire 30 has a first connection hole 31*a* to which the spring hook unit 41 of the spring 40 is fixed.

The first connection unit 31 and the second connection unit 33 of the wire 30 are desired to be integrally formed with the wire 30 through injection molding.

The second connection unit 33 has a second connection hole 33*a*, which connects to the hinge member 21, and a friction unit 35, which generates friction by making contact with the frame 22.

The friction unit 35 of the second connection unit 33 is formed with at least one protrusion units 36, and generates friction while making contact with the frame 22 when the second connection unit 33 moves according to rotation of the hinge member 21.

The friction unit 35 of the wire 30 maintains a gap distance at constant between the hinge member 21 and the wire 30, and between the side cover 10*b* and the frame 22, and enables an opening and a closing motion of the door 11 in a constant and stable manner.

The roller 23 according to an embodiment of the present disclosure is a rotatable roller, however, the roller 23 may be implemented using a fixed roller that may increase friction.

Figure 8:
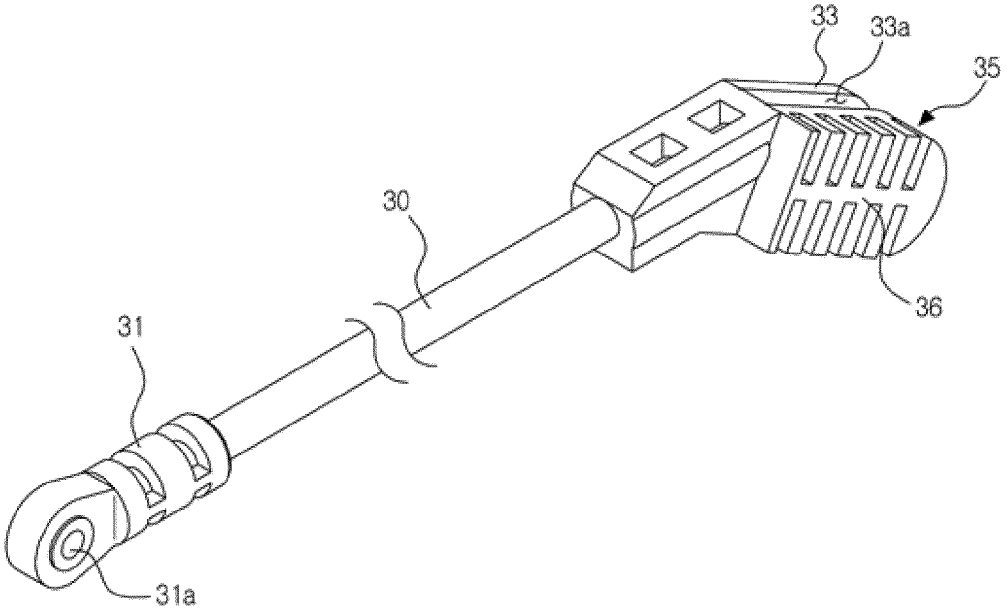
FIG. 8 is a view schematically illustrating a wire of a door hinge according to an embodiment of the present disclosure.
Figure 9:
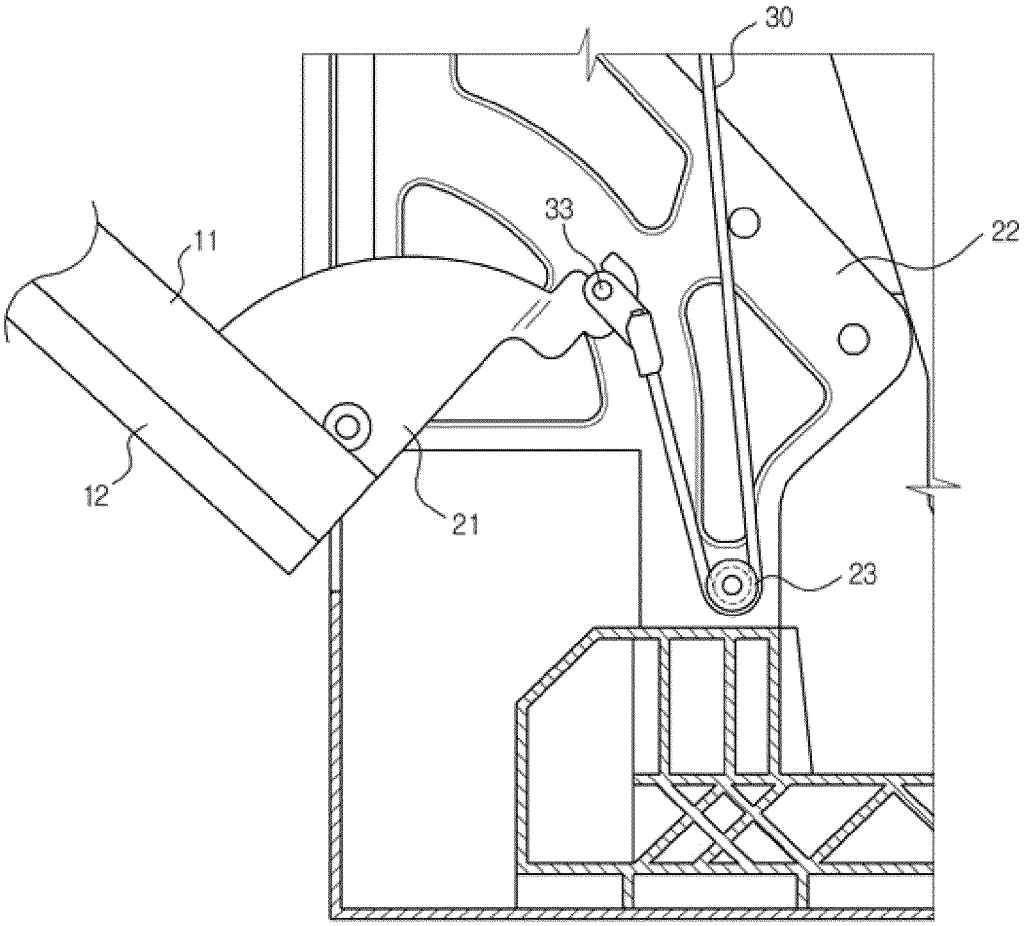
FIG. 9 is a view schematically illustrating a status of a door hinge when a door is open according to an embodiment of the present disclosure.
Figure 10:
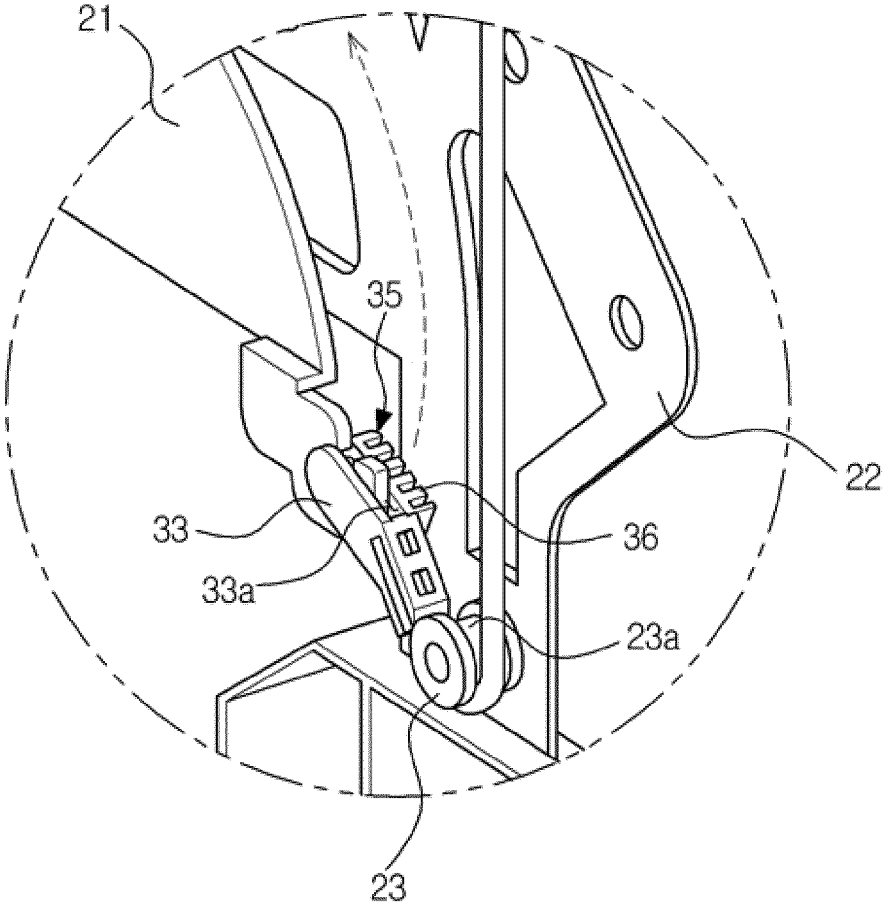
FIG. 10 is a view schematically illustrating a motion of a friction unit of a wire according to an embodiment of the present disclosure.

Referring to FIGS. 8 and 9, a motion of the door hinge 20 of the dishwasher 1 having the above described configuration is as follows.

The wire 30 connects between the hinge member 21 of the door 11 and the spring 20 so that the hinge member 21 is rotatably coupled to the second connection hole 33*a* of the second connection unit 33.

Therefore, when the door 11 is rotated open, the wire 30 is pulled by the second connection unit 33 of the wire 30 connected to the hinge member 21 of the door.

The wire 30 is guided by the slot 23*a* which is formed on the outer surface of the roller 23.

At this time, the protrusion unit 36 of the friction unit 35 formed at the second connection unit 33 generates friction by making contact with the frame 22 on a later side of the housing 10.

Therefore, when the door 11 is open or closed, a first friction is generated between the wire 30 and the roller 23; a second friction is generated between the friction unit 35 and the frame 22, thereby controlling a sensitivity of opening/closing the door 11.

Accordingly, the first and the second frictions generated through the friction unit 35 of the roller 23 and the wire 30 ensure a durability of the wire 30.

In addition, the marginal load of the spring 40 that adjusts the door 11 is reserved, and a stable opening and closing of the door 11 can be achieved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dishwasher comprising:

a housing having a bottom, a rear, and side covers;

a door rotatably installed on a front surface of the housing;

a door hinge installed onto each lower end of the door while being rotatably coupled to the housing;

a spring configured to adjust a rotation of the door; and an apparatus to adjust the spring configured to adjust a load of the spring, the apparatus being positioned inside the housing, and the apparatus comprising a movable bracket connected to the spring, an adjustment member which enables the movable bracket to move up and down, a support bracket configured to support the adjustment member, and a position verification hole perforated through the housing, the position verification hole being configured to visually check by a user a position of the moveable bracket from outside the housing, wherein the door hinge comprises a frame provided on the housing, a hinge member coupled to a lower portion of the door, a roller installed on the frame, and a wire having one end connected to the hinge member and an opposite end connected to the spring, and wherein the wire comprises a first connection unit having a first connection hole to connect the spring, and a second connection unit having a second connection hole to connect to the hinge member, and the second connection unit comprises a friction unit which makes contact with the frame to cause friction.

2. The dishwasher of claim 1, wherein the position verification hole is formed on the side cover.

3. The dishwasher of claim 1, wherein the position verification hole is formed in a vertical direction.

4. The dishwasher of claim 1, wherein the position verification hole comprises two or more position verification holes.

5. The dishwasher of claim 1, wherein the support bracket comprises:

a first support bracket which supports an upper portion of the adjustment member;

a second support bracket which supports a lower portion of the adjustment member while being spaced apart from the first support bracket; and a connection bracket configured to connect the first support bracket to the second support bracket, wherein a penetration hole is formed in each of the first support bracket and the second support bracket such that the adjustment member passes through the penetration hole.

6. The dishwasher of claim 1, wherein the adjustment member comprises a head unit which has a slotted recess or a crossed recess, and a rotation support unit which extends from the head unit downward in a shape of a cylinder while having an outer surface with a screw thread.

7. The dishwasher of claim 6, wherein the movable bracket has a cylindrical unit which penetrates a core of the movable bracket such that the movable bracket is coupled to the adjustment member, and the cylindrical unit is provided at an inner surface thereof with a screw thread corresponding to the screw thread of the adjustment member.

8. The dishwasher of claim 1, wherein the movable bracket is formed through one end portion with an installation hole to which one end portion of the spring is connected.

9. The dishwasher of claim 1, wherein the roller comprises at least one of a fixed roller or a rotatable roller.

10. The dishwasher of claim 1, wherein the roller comprises at least one roller.

11. The dishwasher of claim 1, wherein the friction unit comprises at least one protrusion that protrudes to make a contact with the frame.

12. The dishwasher of claim 1, wherein the first and the second connection units are integrally formed with the wire through insert injection molding.

13. A dishwasher comprising:

a door rotatably installed onto a front surface of a housing;

a door hinge provided on the door;

an elastic member which is connected to the door hinge to adjust a movement of the door;

a movable bracket connected to the elastic member;

an adjustment member which enables the movable bracket to move up and down; and a support bracket configured to support the adjustment member, wherein the door hinge comprises a frame provided on the housing, a hinge member coupled to a lower portion of the door, a roller installed on the frame, and a wire having one end connected to the hinge member and an opposite end connected to the elastic member, wherein the wire comprises a first connection unit having a first connection hole to connect the elastic member, and a second connection unit having a second connection hole to connect to the hinge member, and the second connection unit comprises a friction unit which makes contact with the frame to cause friction, and wherein the housing comprises at least one position verification hole which is formed vertically such that a position of the movable bracket is checked from outside the housing.

14. The dishwasher of claim 13, wherein the elastic member comprises a spring.

15. The dishwasher of claim 13, wherein the housing comprises an adjustment hole enabling a tool, which is used to rotate the adjustment member, to be inserted therethrough.

16. The dishwasher of claim 13, wherein the roller comprises at least one of a fixed roller or a rotatable roller.

17. The dishwasher of claim 13, wherein the first and the second connection units are integrally formed with the wire through insert injection molding.

* * * * *